US006021941A

United States Patent [19]

Schultz

[11] Patent Number: 6,021,941

[45] Date of Patent: Feb. 8, 2000

[54] PRODUCT PACKAGE HAVING CANTILEVERED EXTENSIONS

[75] Inventor: Lucy Schultz, Playa Del Rey, Calif.

[73] Assignee: Mattel, Inc., El Segundo, Calif.

[21] Appl. No.: 09/133,641

[22] Filed: Aug. 13, 1998

[51] Int. Cl.[7] ..... B65D 5/42; A63F 3/00

[52] U.S. Cl. ..... 229/103; 229/116.1; 229/125.19; 273/287; 446/75

[58] Field of Search ..... 229/103, 116.1, 229/125.19; 273/287; 40/312; 206/459.5; 446/75

[56] References Cited

U.S. PATENT DOCUMENTS

| | | | |
|---|---|---|---|
| 1,682,594 | 8/1928 | Benjamin . | |
| 1,982,780 | 12/1934 | Behrens . | |
| 2,018,393 | 10/1935 | Andrews . | |
| 4,140,317 | 2/1979 | Ramney . | |
| 4,326,356 | 4/1982 | Mason | 229/103 |
| 4,548,352 | 10/1985 | Capo et al. | 229/116.1 |
| 4,784,314 | 11/1988 | Penick | 40/312 |
| 4,896,819 | 1/1990 | Grossman | 229/116.1 |
| 5,054,611 | 10/1991 | Russomanno et al. | 40/312 |
| 5,100,016 | 3/1992 | Wischusen, III | 229/125.19 |
| 5,219,116 | 6/1993 | Hearne | 40/312 |
| 5,303,863 | 4/1994 | Arasim . | |
| 5,332,093 | 7/1994 | Littlepage . | |
| 5,454,508 | 10/1995 | Billen . | |
| 5,458,521 | 10/1995 | Todd . | |
| 5,542,870 | 8/1996 | Westersund . | |
| 5,575,384 | 11/1996 | Saye | 206/459.5 |
| 5,586,659 | 12/1996 | Trumbo . | |
| 5,913,517 | 6/1999 | Gaffney et al. | 273/287 |

FOREIGN PATENT DOCUMENTS

| | | |
|---|---|---|
| 159441 | 3/1921 | United Kingdom . |

*Primary Examiner*—Gary E. Elkins
*Attorney, Agent, or Firm*—Roy A. Ekstrand

[57] ABSTRACT

A generally rectangular package top defines a planar top surface and a quartet of perpendicular sidewalls joined to enclose the top surface. A package bottom is configured in substantially the same manner as the package top but is slightly smaller and thus insertable within the sidewalls of the package top. The package top and package bottom are inverted to allow the package top to form an upwardly open-faced base receiving the downwardly open package bottom. A plurality of extensions defining substantially planar surfaces support tabs folded downwardly therefrom which are insertable into the spacing between sidewalls of the package top and package bottom to secure the extensions in a cantilevered support.

19 Claims, 2 Drawing Sheets

PRODUCT PACKAGE HAVING CANTILEVERED EXTENSIONS

FIELD OF THE INVENTION

This invention relates generally to toy or game products and particularly to the packaging used in combination therewith.

BACKGROUND OF THE INVENTION

It is arguable that the toy industry is one of the most intensely competitive industries in the western world. Toy developers constantly explore new areas of toy development and produce a seemingly endless array of varied toys. In recent years, a great deal of development and design effort has also been directed to the development of packaging which will provide an advantage for the toy manufacturer in the marketplace.

For many years, the basic objective of toy and game product packaging has been to provide boxes which, in some instances, are works of art having attractive, colorful and eye-catching depictions of the product, the various trademarks associated with the product, and other messages all intended to pique the interest of the potential consumer. One of the more interesting and somewhat recent trends in product packaging design exploited by practitioners in the toy and game arts has been the imparting of a functional aspect to the package. In accordance with this trend, packages have, in many instances, been produced which include a "try me" feature. This feature derives its name from the ability of the user to sample the operation of the device without breaking product package integrity. Such try-me packages are frequently found in toys having electrical or electronic operating capabilities. Still other functionally directed packages have been found in different games and toys in which the product package is actually used in the play activities.

In addition to developing product packages which meet the basic objective of attraction and colorful and interesting appearance as well as the functional uses such as try-me or the like, product package designers are constrained by competing limitations. For example, the overall size of the product package in comparison to the product size is subject to limitation under various "slack pack" regulations. These regulations prohibit the false packaging of a product in a container which is disproportionately larger than the product requires. Further limitations evolve through economic considerations. It is, of course, less costly to make a smaller package rather than a larger one. However, in terms of the packages ability to attract a purchaser, bigger is better. Thus, the objective of package designers is to properly balance these needs and limitations to provide the optimum product.

One of the most difficult types of product in terms of the dimensional considerations of the package is found in products which have play surfaces such as board games, scene games and the like. Most practitioners resolve this problem by either attempting to have the package unfold into a large sheet or include a folded board-type object. These approaches of course are limited in their commercial viability but often necessary due to the above limitations.

U.S. Pat. No. 1,682,5954 issued to Benjamin sets forth a CARTON having a six-sided package carton formed of a single precut and prefolded blank of material such as cardboard or the like. Various die-cut items are secured within the blank and are foldable to stand vertically upon the underlying surface to provide a background for the toy.

U.S. Pat. No. 5,542,870 issue to Westersund sets forth a FOLDING BOX DIORAMA TOY having a square base and for hingedly connected sidewalls secured thereto. Each sidewall further supports a triangular inwardly extending portion of the top surface. When the sides are folded upwardly to extend perpendicularly from the base, their respective triangles meet and together form the top side of the container.

U.S. Pat. No. 3,982,780 issued to Behrens sets forth a COMBINATION CONTAINER having a container formed of a single blank of material such as cardboard which is multiply cut and folded to provide a closed container or an extended planar play surface.

U.S. Pat. No. 5,332,093 issued to Littlepage sets forth a MAILBOX SHAPED DOLL AND ACCESSORY CARRIER AND BLANK THEREFOR having a planar blank which is configured to fold into a mailbox shape by providing a bendable extended length side used to form the upper surface of the mailbox.

U.S. Pat. No. 5,454,508 issued to Billen sets forth a ONEPIECE VEHICLE REPLICA CONTAINER having a planar blank of suitable material such as cardboard or the like which is shaped and visually decorated to provide a plurality of body parts such that the folding of the container to its closed position produces a model of a vehicle.

U.S. Pat. No. 5,458,512 issued to Todd sets forth a COMBINATION STORAGE CONTAINER AND EDUCATIONAL TOY having a primary container defining a plurality of slots in the outer surfaces thereof. A plurality of foldable elements define respective tabs which enable the elements to be secured to the outer surfaces of the container.

U.S. Pat. No. 5,586,659 issued to Trumbo sets forth a COMBINATION GIFT BOX AND GREETING CARD having a container which unfolds to provide a diorama with foreground and background objects.

U.S. Pat. No. 2,018,393 issued to Andrews sets forth a AMUSEMENT DEVICE having a foldable container defining lens openings and a film shuttle on opposite ends of the container. A film is threaded through the device to be viewed through the lens openings.

U.S. Pat. No. 4,140,317 issued to Ramney sets forth a CONTAINERIZED GREETING CARD AND GAME TOY constructed of cardboard, plastic or similar material and made up of several sections forming panels together with flaps foldable along folding lines into a flat container. The container opens to lie flat and provide a play surface.

U.S. Pat. No. 5,303,863 issued to Arasim sets forth a BEVERAGE CARTON WITH INTEGRAL COOLER BIN while British Patent 159,441 issued to Palmer, et al. sets forth a suitcase-like toy in which the interior of the suitcase supports a plurality of toy items such as a toy landscaping scene while the interior surface of the cover is pivotable to a vertical position and supports a cooperating scene related to and extending from the interior of the suitcase.

While the foregoing described prior art devices have, to some extent, improved the art and in some instances, enjoyed commercial success, there remains nonetheless a continuing need in the art for evermore improved, interesting, amusing and cost efficient packages for use in products such as games or toys. There remains a particular facet of this need in connection with the objective of providing a maximization of "play size" while concurrently providing an optimally sized package for storage, transport and other considerations.

SUMMARY OF THE INVENTION

Accordingly, it is a general object of the present invention to provide an improved package for toys and games. It is a more particular object of the present invention to provide an improved package for toys and games which provides maximum utilization of a given product container size while maintaining package integrity and usefulness.

In accordance with the present invention, there is provided a product package comprising: a package top defining a top surface and a first plurality of sidewalls generally perpendicular to the top surface and joined to the top surface and to each other to form a first open-faced enclosure; a package bottom smaller than the package top and defining a bottom surface and a second plurality of sidewalls generally perpendicular to the bottom surface and joined to the bottom surface and each other to form a second open-faced enclosure; and a plurality of cantilevered extensions each having an extension surface and a pair of tabs substantially perpendicular to the surface, the package bottom being inserted into the package top and the combination thereof being inverted and the cantilevered extensions being secured to the inverted combination by insertion of the tabs between the sidewalls of the package top and bottom.

Stated differently, the invention provides a product package comprising: an open-faced package top defining an enclosed interior; a package bottom smaller than the package top and defining a bottom surface, the package bottom being received within the interior and the package bottom and top being inverted; and a plurality of cantilevered extensions each having an extension surface and at least two tabs, the tabs being inserted between the package top and the package bottom to secure the extension thereto.

BACKGROUND OF THE INVENTION

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a product package constructed in accordance with the present invention and configured for game play;

FIG. 2 sets forth a perspective assembly of the package of FIG. 1;

FIG. 3 sets forth a perspective view of a cantilevered element of the present invention product package; and FIG. 4 sets forth a section view of the present invention product package taken along section lines 4—4 in FIG. 1.

DESCRIPTION OF THE PREFERRED EMBODIMENT

Figure 1:
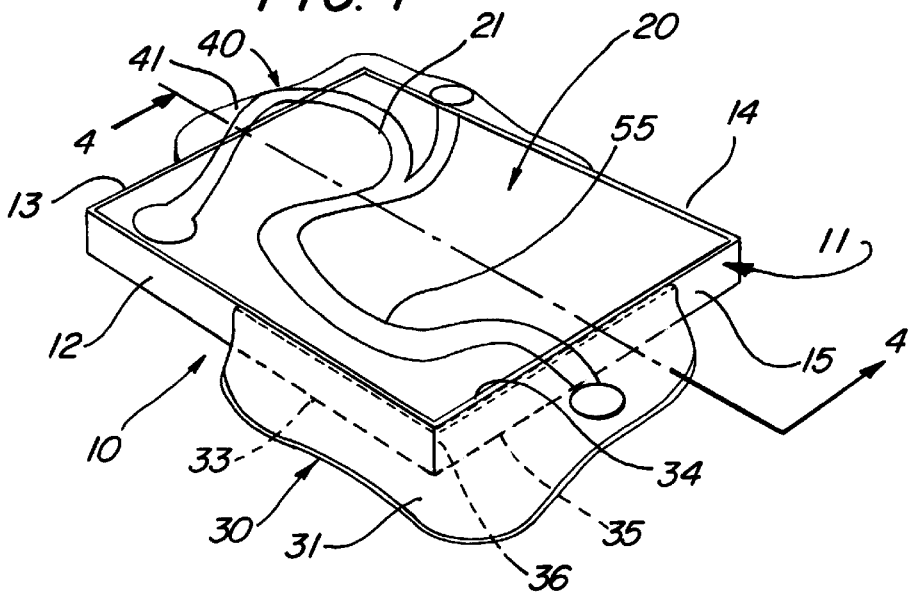

FIG. 1 sets forth a perspective view of a product package constructed in accordance with the present invention and generally referenced by numeral 10. Package 10 is shown in FIG. 1 having a package top 11 and a package bottom 20. It will be noted that package top 11 and package bottom 20 are inverted in the configuration shown in FIG. 1. Thus, in the anticipated use of the present invention, package top 11 during active play use is inverted and positioned to rest upon a play surface and to receive a correspondingly inverted package bottom 20. In further accordance with the present invention, a pair of cantilevered extensions 30 and 40 are joined to package bottom 20 and package top 11 in the manner set forth below in greater detail.

More specifically, package 10 includes a package top having a plurality of sidewalls 12, 13, 14 and 15 which enclose a rectangular top surface 16 (seen in FIG. 2) to form an open box element. Correspondingly, package bottom 20 defines a plurality of sidewalls 22, 23, 24 and 25 enclosing a generally rectangular bottom surface 21 (seen in FIG. 2). Package bottom 20 is slightly smaller than package top 11 and thus is able to fit within the sidewalls of package top 11.

The configuration of package top 11 and package bottom 20 may be fabricated entirely in accordance with conventional fabrication techniques. Thus, with the exception of extensions 30 and 40, package 10 forms a simple package in which the slightly larger package top provided by top 11 is received upon package bottom 20. While various materials may be used to fabricate package top 11 and package bottom 20, it has been found advantageous to utilized planar materials formed of rigid cardboard, molded plastic, or particulate material board as desired. It will be understood, however, that the present invention package may be fabricated using virtually any sufficiently rigid planar material without departing from the spirit and scope of the present invention.

In accordance with the present invention, an extension 30 formed of a planar material defines an upper surface 31 and a pair of folding tabs 33 and 35 joined to surface 31 along fold lines 32 and 34. As is better seen in FIG. 3, extension 30 is fabricated from a single planar sheet of cardboard, molded plastic or particulate board material. In further accordance with FIG. 3, tabs 33 and 35 are folded about their respective fold lines to define an approximate right angle between surface 31 of extension 30. Extension 30 is assembled to package top 11 and package bottom 20 by aligning tabs 33 and 35 with a selected corner of the package top and bottom. Thereafter, tabs 33 and 35 are forced between the respective overlapping sidewalls of the package top and package bottom. In the preferred fabrication of the present invention, the fit of package bottom 20 within package bottom 11 is relatively tight assuring that tabs 33 and 35 will be tightly received and gripped between the sidewalls of package top 11 and package bottom 20. As is better seen in FIG. 4, the preferred fabrication of the present invention provides general planar alignment between surface 31 of extension 30 and bottom surface 21 of package bottom 20.

Figure 2:
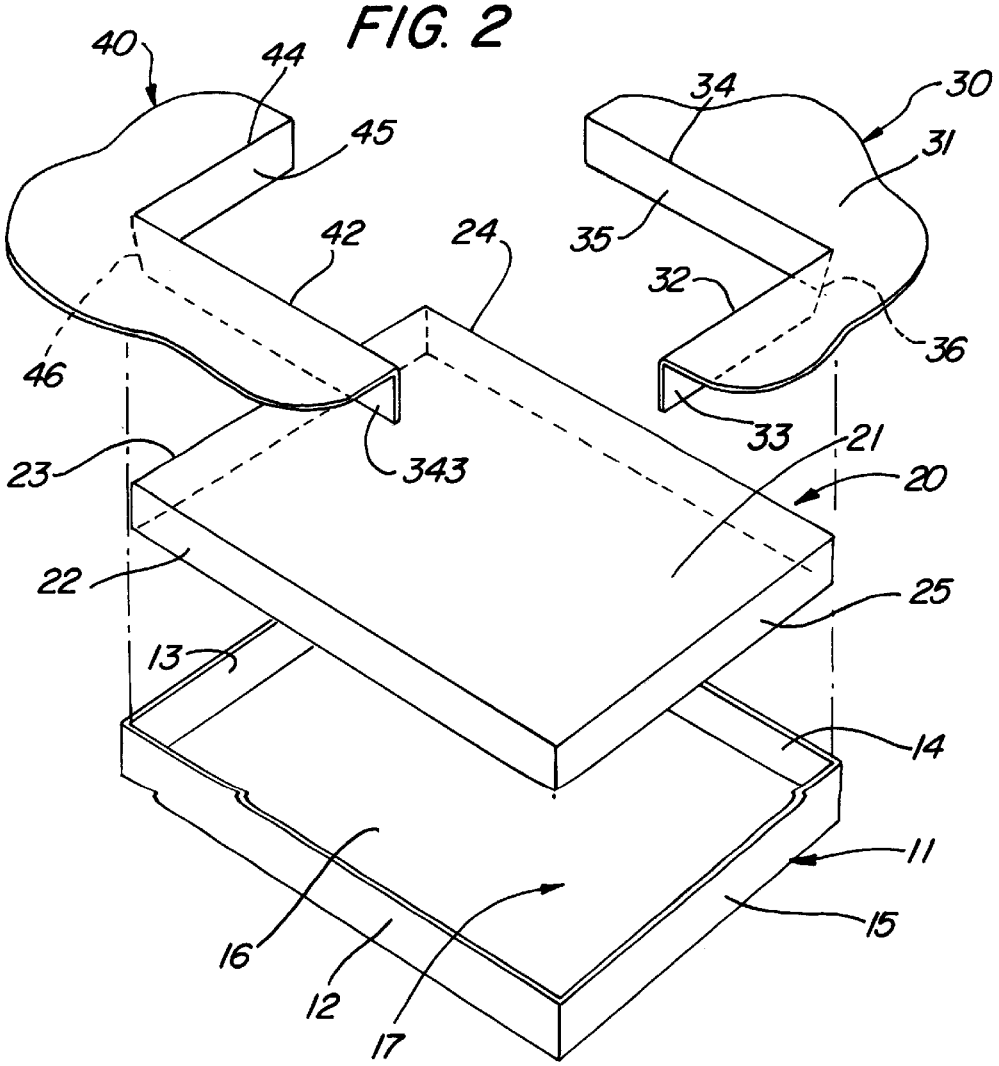

Similarly, extension 40 defines an upper surface 41 and a pair of tabs 43 and 45 folded about respective fold lines 42 and 44 (tabs 43 and 45 and fold lines 42 and 44 shown in FIG. 2). Thus, in the assembled position shown in FIG. 1, extension 40 is positioned at a selected corner of package bottom 20 and package top 11 and is secured thereto by an insertion of its tabs between the sidewalls of package top 11 and package bottom 20 in correspondence with the attachment of extension 30 described above.

It will be apparent to those skilled in the art that while a pair of cantilevered extensions 30 and 40 are shown positioned at opposite corners of package top 11 and package bottom 20, the present invention is not limited to such a specific arrangement. Accordingly, extensions 30 and 40 may be placed at any selected corners of the package top and bottom. It will be equally apparent to those skilled in the art that the present invention is not limited to a pair of extensions. On the contrary, it will be understood that extensions may be placed at each of the corners of the package top and package bottom structure.

In accordance with an important aspect of the present invention, the cantilevered support of extensions 30 and 40 provide an effective increase in the available play surface of package 10 which would otherwise be limited to package bottom surface 21. The cantilever attachment of extensions 30 and 40 provide sufficient support strength to ensure that the upper surfaces of the extensions stay substantially horizontal and substantially coplanar with bottom surface 21. Of further importance with respect to the present invention, it will be noted that extensions 30 and 40 may be folded back to the configuration shown in FIG. 3 at the conclusion of play and stored conveniently within the package. It will be further noted that the structure of extensions 30 and 40 provides an extended play surface without interfering with the contents of package top 11 and package bottom 20. Thus, extensions 30 and 40 of the present invention dramatically increase play area of the host package while leaving the remainder of the package to operate in accordance with its intended storage and transport purpose.

FIG. 2 sets forth a perspective assembly view of package 10 includes a package top 11, a package bottom 20, and a pair of cantilever extensions 30 and 40. In the assembly view of FIG. 2, package top 11 is inverted from its normal position when used in packaging or storing product within the package and is preferably placed upon a convenient flat play surface such as a table top or the like. Package bottom 20 is also inverted and is received within package top 11 such that a bottom surface 21 of package bottom 20 provides an uppermost surface of the combination of package top 11 and package bottom 20. Extensions 30 and 40 are inserted using downwardly extending tabs between the sidewalls of package top 11 and package bottom 20.

More specifically, package top 11 includes a generally rectangular top surface 16 together with a plurality of enclosing sidewalls 12, 13, 14 and 15 joined at right angles to the edges of top surface 16. As a result, package top 11 defines an open-faced interior 17. Package bottom 20 is inverted from its normal packaging orientation and defines a generally rectangular bottom surface 21 having a plurality of sidewalls 22, 23, 24 and 25 substantially perpendicular to surface 21 and joined to form a rectangular open-faced container.

As mentioned above, package top 20 is preferably sized to be slightly smaller than the interior dimensions of package top 11 and thus is assembled to package top 11 by inserting sidewalls 22, 23, 24 and 25 into interior 17 causing the sidewalls to be aligned respectively with sidewalls 12, 13, 14 and 15 of package top 11.

Figure 3:
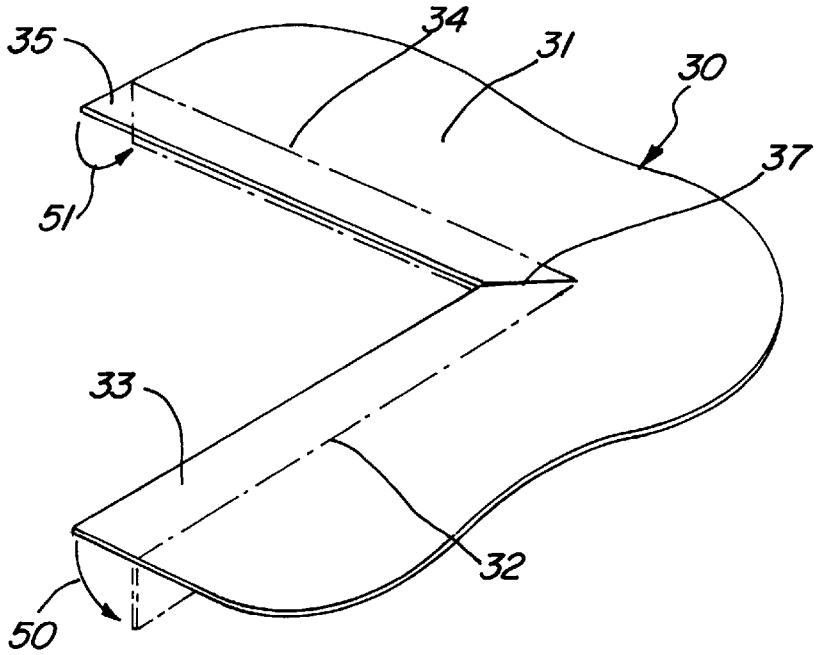

In further accordance with an important aspect of the present invention, a cantilevered extension 30 is preferably formed of a rigid cardboard or plastic or other suitable material and defines a pair of tabs 33 and 35 folded downwardly as indicated in FIG. 3 about their respective fold lines 32 and 34. The downward folding of tabs 33 and 35 forms a corner 36 which is angled due to the use of a mitre cut 37 (seen in FIG. 3) formed in extension 30.

Extension 40 is similar to extension 30 and defines a planar surface 41 having a pair of tabs 43 and 45 extending downwardly therefrom after having been folded upon fold lines 42 and 44. A corner 46 is formed between tabs 43 and 45 which is preferably angled due to the above-mentioned mitre cut (mitre cut 37 seen in FIG. 3).

The assembly of package 10 into the play configuration shown in FIG. 1 is carried forward by initially placing inverted package bottom 20 into interior 17 of inverted package top 11. Thereafter, extension 30 is secured to the combination of top 11 and bottom 20 by inserting tabs 33 and 35 into the space between sidewalls 25 and 24 of package bottom 20 and sidewalls 15 and 14 of package top 11 respectively.

Similarly, extension 40 is secured to the package structure by inserting tabs 35 and 45 into the spacing between sidewalls 22 and 23 of package bottom 20 and sidewalls 12 and 13 of package top 11. At this point in assembly, package 10 assumes the configuration shown in FIG. 1. It will be noted that in accordance with a further advantage of the present invention package, the positions of extensions may be moved to different corners during the course of game play should this be desirable. By way of further advantage of the present invention, the extensions may be interchanged in the course of game play.

In the anticipated use of the present invention package, bottom surface 21 of package bottom 20 together with surfaces 31 and 41 of extensions 30 and 40 support visually attractive game play or scene elements which are generally contiguous and cooperating. As a result, a continuous surface for game play having suitable visual images and game elements printed upon surfaces 31 and 41 together with surface 21 may provide a substantially increased field of play without increasing the size of the package or requiring that the package unfold. If, for example, the present invention package is used in connection with a board game, the board game path may move about bottom surface 21 of package bottom 20 and surfaces 31 and 41 of extensions 30 and 40. By way of example and with temporary reference to FIG. 1, a multiply curved board game play path 55 is shown traversing extension 30 onto bottom surface 21 of package bottom 20 and thereafter traversing extension 40. Thus, it will be seen that the image elements upon bottom surface 21 of package bottom 20 and surfaces 31 and 41 of extensions 30 and 40 greatly expand the available space for any given product package size.

FIG. 3 sets forth a perspective view of extension 30 having an upper surface 31, a pair of tabs 33 and 35, a pair of fold lines 32 and 34 and a mitre cut 37. Cut 37 is utilized to permit extension 30 to be fabricated of a single sheet of die-cut material and provides clearance between the tabs for folding. In accordance with an important aspect of the present invention, tabs 33 and 35 are folded downwardly in the directions indicated by arrows 50 and 51 along fold lines 32 and 34 to form extension 30 into the configuration utilized in securing it in a cantilever attachment to package top 11 and package bottom 20 as shown below. At the conclusion of game play, extension 30 may be folded flat again by folding tabs 33 and 35 upwardly to the position shown in FIG. 3 allowing convenient, compact storage of the game elements. In a similar manner, it will be understood that extension 40 shown in FIGS. 1 and 2 is fabricated in accordance with extension 30 and thus the descriptions of extension 30 set forth in FIG. 3 will be understood to apply equally well to extension 40.

Figure 4:
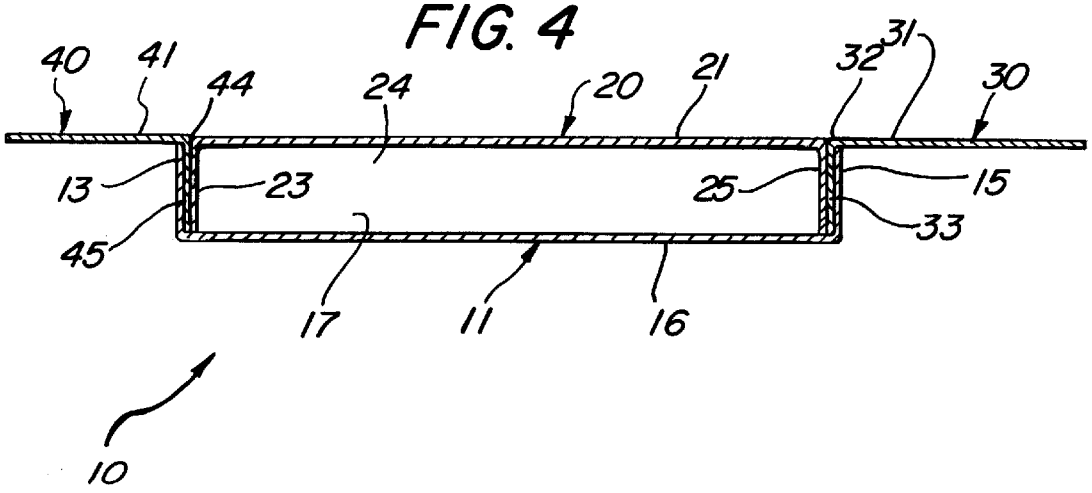

FIG. 4 sets forth a section view of package 10 taken along section lines 4—4 in FIG. 1. As described above, package top 11 defines a top surface 16 together with a plurality of sidewalls 12, 13, 14 and 15 (sidewalls 12 and 14 seen in FIG. 2). As is also described above, package top 11 defines an open-faced interior enclosure 17. Package bottom 20 defines a planar surface 21 having sidewalls 22, 23, 24 and 25 extending orthogonally therefrom (sidewall 22 seen in FIG. 2).

In the position shown in FIG. 4, package top 11 is inverted to be open-faced in an upward direction while package bottom 20 is inserted into interior 17 and is oriented to provide a downwardly open-faced enclosure.

In accordance with the present invention, a pair of cantilevered extensions 30 and 40 are secured to the combination of package top 11 and package bottom 20 in the manner described above and shown in FIGS. 1 and 2. More particularly, tab 32 of extension 30 is inserted between sidewall 25 of package bottom 20 and sidewall 15 of package top 11. Tab 33 is thus tightly confined within the present invention package and supports extension 30. Similarly, extension 40 is secured to package top 11 and package bottom 20 by inserting tab 45 between sidewalls 13 and 23 of package top 11 and package bottom 20 respectively. Once again, the insertion of tabs of each extension as described above supports extensions 30 and 40 in a cantilevered attachment which does not require supports beneath surfaces 31 and 41.

The disassembly of package 10 from its play configuration shown in FIGS. 1, 2 and 4 is carried forward by simply lifting extensions 30 and 40 upwardly withdrawing their securing tabs and thereafter folding the tabs of each extension to form the flat structure shown in solid-line representation in FIG. 3. Finally, the combination of package top 11 and package bottom 20 is inverted back to its normal packaging position and package top 11 is withdrawn from package bottom 20 allowing for the convenient storage of extensions 30 and 40 as well as other game play articles.

What has been shown is a novel product package which provides a plurality of cantilevered extensions which are attachable to the product package to form a game play or play pattern configuration. The inventive structure is capable of using an otherwise conventional package top and package bottom without requiring modification or alteration of the structure. Thus, the present invention product provides the benefits found in increased space provided by prior art structures having foldable or flattenable cartons while maintaining the strength and packaging integrity found in package top and bottom combinations which utilize securely joined corners at their respective sidewalls.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A product package comprising:

a package top defining a top surface and a first plurality of sidewalls generally perpendicular to said top surface and joined to said top surface and to each other to form a first open-faced enclosure;

a package bottom smaller than said package top and defining a bottom surface and a second plurality of sidewalls generally perpendicular to said bottom surface and joined to said bottom surface and each other to form a second open-faced enclosure; and a plurality of cantilevered extensions each having an extension surface and a pair of tabs substantially perpendicular to said surface, said package bottom being inserted into said package top and the combination thereof being inverted and said cantilevered extensions being secured to said inverted combination by insertion of said tabs between said sidewalls of said package top and bottom.

2. The product package set forth in claim 1 wherein said top surface of said package top and said bottom surface of said package bottom are generally rectangular.

3. The product package set forth in claim 2 wherein said first and second pluralities of sidewalls form generally rectangular enclosures having corners.

4. The product package set forth in claim 3 wherein said pairs of tabs of said extensions each form a generally right-angle corner portion.

5. The product package set forth in claim 4 wherein said cantilevered extensions are formed of a generally flat member having a right-angle pair of fold lines intersecting at a fold corner and defining said pair of tabs meeting at an angle cut formed in said pair of tabs extending outwardly from the point of intersection of said fold lines.

6. The product package set forth in claim 5 wherein said bottom surface and said plurality of extension surfaces each bear image elements thereon.

7. The product package set forth in claim 6 wherein each of said image elements on said extension surfaces are visually contiguous with a portion of said image elements formed on said bottom surface.

8. The product package set forth in claim 1 wherein said bottom surface and said plurality of extension surfaces each bear image elements thereon.

9. The product package set forth in claim 8 wherein each of said image elements on said extension surfaces are visually contiguous with a portion of said image elements formed on said bottom surface.

10. The product package set forth in claim 6 wherein said top surface of said package top and said bottom surface of said package bottom are generally rectangular.

11. The product package set forth in claim 10 wherein said first and second pluralities of sidewalls form generally rectangular enclosures having corners.

12. The product package set forth in claim 11 wherein said pairs of tabs of said extensions each form a generally right-angle corner portion.

13. A product package comprising:

an open-faced package top defining an enclosed interior;

a package bottom smaller than said package top and defining a bottom surface, said package bottom being received within said interior and said package bottom and top being inverted; and a plurality of cantilevered extensions each having an extension surface and at least two tabs, said tabs being inserted between said package top and said package bottom to secure said extension thereto.

14. The product package set forth in claim 13 wherein said extension surfaces and said bottom surface are substantially coplanar.

15. The product package set forth in claim 13 wherein said bottom surface and said plurality of extension surfaces each bear image elements thereon.

16. The product package set forth in claim 15 wherein each of said image elements on said extension surfaces are visually contiguous with a portion of said image elements formed on said bottom surface.

17. The product package set forth in claim 13 wherein said top surface of said package top and said bottom surface of said package bottom are generally rectangular.

18. The product package set forth in claim 17 wherein said first and second pluralities of sidewalls form generally rectangular enclosures having corners.

19. The product package set forth in claim 18 wherein said pairs of tabs of said extensions each form a generally right-angle corner portion.

* * * * *